US006644893B2

(12) United States Patent
Johnson

(10) Patent No.: US 6,644,893 B2
(45) Date of Patent: Nov. 11, 2003

(54) RIGID JACKET OF AN OFFSHORE PLATFORM HAVING A QUADRAPOD STRUCTURE

(75) Inventor: Paul R. Johnson, Houston, TX (US)

(73) Assignee: Marathon Oil Company, Findlay, OH (US)

( * ) Notice: Subject to any disclaimer, the term of this patent is extended or adjusted under 35 U.S.C. 154(b) by 0 days.

(21) Appl. No.: 09/901,973

(22) Filed: Jul. 9, 2001

(65) Prior Publication Data

US 2003/0007837 A1 Jan. 9, 2003

(51) Int. Cl.[7] ..... E02B 17/00

(52) U.S. Cl. ..... 405/209; 405/203; 405/195.1; 114/265

(58) Field of Search ..... 405/203, 204, 405/205, 207, 208, 224, 195.1, 209; 114/264, 265, 258

(56) References Cited

U.S. PATENT DOCUMENTS 4,086,777 A * 5/1978 Lai ..... 405/195.1
4,958,960 A * 9/1990 Turner et al. ..... 405/195.1
5,380,130 A * 1/1995 Kessler et al. ..... 405/195.1
5,480,265 A 1/1996 Marshall et al. ..... 405/224
5,527,136 A * 6/1996 Bayazitoglu et al. ..... 405/227
5,588,781 A 12/1996 Smolinski et al. ..... 405/195.1
5,642,966 A 7/1997 Morrison et al. ..... 405/195.1
6,299,384 B1 * 10/2001 Glasscock et al. ..... 405/224 X
6,340,273 B1 * 1/2002 Hull ..... 405/195.1 X

* cited by examiner

*Primary Examiner*—Heather Shackelford
*Assistant Examiner*—Sunil Singh
(74) *Attorney, Agent, or Firm*—Jack E. Ebel

(57) ABSTRACT

A launchable rigid jacket of an offshore platform has a structure including an exterior framing and a plurality of cross-sectional frame sections. The exterior framing has four outside legs, which are spaced apart to define four corners of a trapezoidal cross section. The jacket also includes two launch runners mounted on adjacent parallel outside legs. The cross-sectional frame sections are horizontally positioned at periodic intervals along the height of the jacket and each has a plurality of members, which interconnect the four outside legs and are part of the exterior framing. The exterior framing in total defines an integral launch box for the jacket. A plurality of perpendicularly oriented conductors pass through each cross-sectional frame from the base to the top of the jacket and conductor guides connected to the respective frame sections slidably engage the conductors to laterally support them.

16 Claims, 7 Drawing Sheets

14
10
82
80
76
78
22
46d
56
68c
18
66c
16
46c
24d
68b
66b
46b
24b
20
68a
66a
24c
60b
12
46a
60a
24a 14
18
36d
28c
36c
28b
36b
44
24d
28a
24c
36a
12

14
22
40d
32c
60b
62b
40c
64b
32b
40b
24d
42
32a
24b
44
40a
12

RIGID JACKET OF AN OFFSHORE PLATFORM HAVING A QUADRAPOD STRUCTURE

TECHNICAL FIELD

The present invention relates generally to an offshore platform for a hydrocarbon production facility, and more particularly to a rigid jacket of the offshore platform which has a quadrapod structure.

BACKGROUND OF THE INVENTION

Offshore production of hydrocarbons is typically enabled by placement of a platform at a desired offshore site. The platform comprises a jacket and a deck supported by the jacket, which houses a hydrocarbon production facility. The height of the upright jacket is greater than the depth of the water at the offshore site of the platform so that when the base of the jacket is positioned on the sea floor, the top of the jacket extends above the sea surface. The deck is mounted atop the jacket so that the deck is likewise positioned above the sea surface. Most offshore platforms are bottom-founded structures, which are fixed to the sea floor by attaching pilings driven into the sea floor to the base of the jacket.

There are a number of criteria, which must be considered in designing the jacket of a bottom-founded offshore platform. In particular, the jacket must be designed with sufficient strength to resist collapse or bending during periods of high loads or stress. For example, the jacket incurs relatively high loads or stress during initial placement of the jacket at the offshore site and during prolonged continuous in-place operation of the offshore platform in the sea environment, where the jacket is exposed to a broad range of wave forces. Waves are characterized by their height and period. Very large or tall waves are long period waves because of the physical limits on the steepness of the waves, while small or short waves are short period waves. For example, a classical Gulf of Mexico hurricane wave is 75 feet high and has a 12 second period. Smaller waves have correspondingly shorter heights and shorter periods.

Bottom-founded jackets are characterized as either "rigid" or "compliant". A rigid jacket is substantially stiffer along its length than a compliant jacket. A rigid jacket is designed and constructed with sufficient strength to prevent the platform from being pushed over by very large waves. The natural period of sway for a rigid jacket is usually less than 3 seconds and the natural period of whipping is significantly shorter. The short natural period of the jacket avoids a resonant sway response to more numerous small waves, which could damage the platform through fatigue.

A compliant jacket, such as disclosed in U.S. Pat. No. 5,480,265, is not strong enough to directly resist large waves. Instead, a compliant jacket relies on substantial inertia and a very long sway period on the order of about 45 seconds to prevent the platform from being pushed over by very large waves. Thus, even very large waves with 12 to 16 second periods pass through the jacket too quickly for the jacket to respond to the wave. However, the fundamental requirement of a long sway period limits the utility of compliant jackets to relatively deep water on the order of about 1000 feet or more. The critical fatigue issue for a compliant jacket having a long sway period is the whipping period, which causes the jacket undue fatigue if it is too great. Therefore, it is necessary to design and construct a compliant jacket having a sufficiently long sway period, yet also having a whipping period within acceptable limits, to avoid failure of the jacket structure from wave induced fatigue. Although compliant jackets can frequently be constructed at a lower cost than rigid jackets due to reduced material requirements, design of compliant jackets can oftentimes be more complex than rigid jackets due to the difficulty in achieving both an optimal sway period and an optimal whipping period.

As noted above, the jacket is subjected to relatively high loads and stresses both during placement of the jacket and during in-place operation of the offshore platform. These loads and stresses have different characteristics, which must be considered in the design of the jacket. Most jackets are fabricated at onshore locations. After fabrication, the jacket is loaded onto a transport barge with the jacket lying on its side in a horizontal orientation. The jacket is transported atop the transport barge to a desired offshore site for placement. Placement of the horizontally oriented jacket on the sea floor is effected by one of two methods, either lifting or launching. The lifting method employs a heavy-lift vessel positioned alongside the transport barge, which engages the horizontal jacket, raises the jacket off the deck of the barge, reorients the jacket to an upright vertical position, and sets the jacket down in a vertical orientation on the sea floor at the desired offshore site. The launching method tilts the deck of the transport barge so that the horizontal jacket, which has a plurality of interior buoyancy compartments, slides laterally under the force of gravity along the deck into the sea and floats in a substantially horizontal orientation on the sea surface. The jacket interior is then flooded in a controlled manner, upending the jacket to a vertical orientation. A derrick barge positions the jacket over the desired offshore site and the jacket interior is flooded further, setting the jacket down on the sea floor.

A jacket, which is placed by the launch method, is preferably provided with a plurality of launch runners to facilitate sliding the jacket off of the barge. The launch runners protrude from the external framing of the jacket and are typically fortified by a separate launch box, which is added to the framing of the jacket and strengthens the jacket structure against the severe loads and stresses encountered during launch of the jacket.

There are any number of rigid jacket configurations known in the prior art. Nevertheless, it is commonly recognized that the most efficient configuration of a rigid jacket is a tripod configuration having three convergent legs. By most efficient configuration, it is meant that the tripod configuration achieves the greatest strength with the lowest material requirements, at least with respect to in-place operation of the platform. However, a rigid jacket having the tripod configuration lacks two parallel legs, to which launch runners can be mounted for launching the jacket. Therefore, placement of a rigid tripod jacket must be performed by the lift method. This undesirably limits the maximum design weight of the jacket to the capacity of the available heavy-lift vessel, which in turn limits the water depth and topsides load capacity for which the jacket can be designed.

The present invention recognizes a need for a launchable jacket having the desired in-place performance characteristics of a rigid jacket, yet having substantially reduced material requirements relative to known launchable rigid jacket designs. Accordingly, it is an object of the present invention to provide a launchable rigid jacket, which has sufficient strength to resist damage or failure caused by launching the jacket from a barge at a desired offshore site. It is another object of the present invention to provide such a launchable rigid jacket, which has sufficient strength to resist damage or failure caused by wave forces during in-place operation of the jacket at the offshore site. It is still another object of the present invention to provide such a launchable rigid jacket, which has reduced material requirements for its construction. These objects and others are accomplished in accordance with the invention described hereafter.

SUMMARY OF THE INVENTION

The present invention is a launchable rigid jacket of an offshore platform. The jacket is characterized by a base, a top and a height extending from the base to the top. The jacket has a structure including an exterior framing and a plurality of cross-sectional and intermediate frame sections. The exterior framing comprises four outside legs, each extending at least a majority of the height of the jacket. A first pair of the four outside legs is more closely spaced apart and a second pair of the four outside legs is more widely spaced apart to define four corners of a trapezoidal cross section of the exterior framing.

The cross-sectional frame sections are horizontally positioned at periodic intervals along the height of the jacket between the base and the top and the intermediate frame sections are horizontally positioned between adjacent pairs of the cross-sectional frame sections. Each of the cross-sectional frame sections has a front member, a rear member, a first lateral member and a second lateral member, which interconnect the four outside legs. The front, rear, first lateral, and second lateral members are part of the exterior framing and, in association with the four outside legs, provide each cross-sectional frame section with a cross section corresponding to the trapezoidal cross section of the exterior framing. The exterior framing in total defines an integral launch box for the jacket.

Each cross-sectional frame section encloses a cross-sectional conductor opening having at least one substantially perpendicularly oriented conductor passing therethrough from the base to the top. A cross-sectional conductor guide is positioned in each cross-sectional conductor opening and is connected to the cross-sectional frame section. The cross-sectional conductor guide slidably engages the conductor to laterally support the conductor, thereby permitting independent vertical movement of the conductor relative to the cross-sectional frame section while substantially preventing independent horizontal movement of the conductor relative to the cross-sectional frame section.

Each intermediate frame section only partially extends across the trapezoidal cross section of the exterior framing. The intermediate frame section encloses an intermediate conductor opening having the conductor passing therethrough. An intermediate conductor guide is positioned in the intermediate conductor opening and is connected to the intermediate frame section. The intermediate conductor guide slidably engages the conductor to laterally support the conductor, thereby permitting independent vertical movement of the conductor relative to the intermediate frame section while substantially preventing independent horizontal movement of the conductor relative to the intermediate frame section.

The jacket further comprises a first launch runner and a second launch runner. The first launch runner is mounted on one of the first pair of outside legs, which are more closely spaced apart, and the second launch runner is mounted on the other of the first pair of outside legs. The first pair of outside legs has a substantially parallel orientation to one another where the first and second launch runners are mounted.

The present invention is also a method for placing a launchable rigid jacket at an offshore site in a sea environment having a sea floor and a sea surface. The method comprises providing a jacket as described above and positioning the jacket on a barge deck of a transport barge in a horizontal orientation with the first and second launch runners engaging the barge deck. In particular, the first launch runner engages a first skidway formed in the barge deck and the second launch runner engages a second skidway formed in the barge deck. The jacket is transported on the transport barge to the offshore site and launched from the transport barge at the offshore site by sliding the first and second launch runners along the first and second skidways in the barge deck. The first and second launch runners are in continuous contact with the first and second skidways until the jacket departs the barge deck. The integral launch box bears launch loads on the jacket to prevent structural failure of the jacket during launching. Upon completion of launching, the jacket is upended, positioned and fixed to the sea floor with the base proximal to the sea floor and the top proximal to the sea surface. An above-water deck is then mounted to the top and is rigidly supported by the jacket.

The present invention will be further understood from the drawings and the following detailed description.

DESCRIPTION OF PREFERRED EMBODIMENTS

Figure 1:
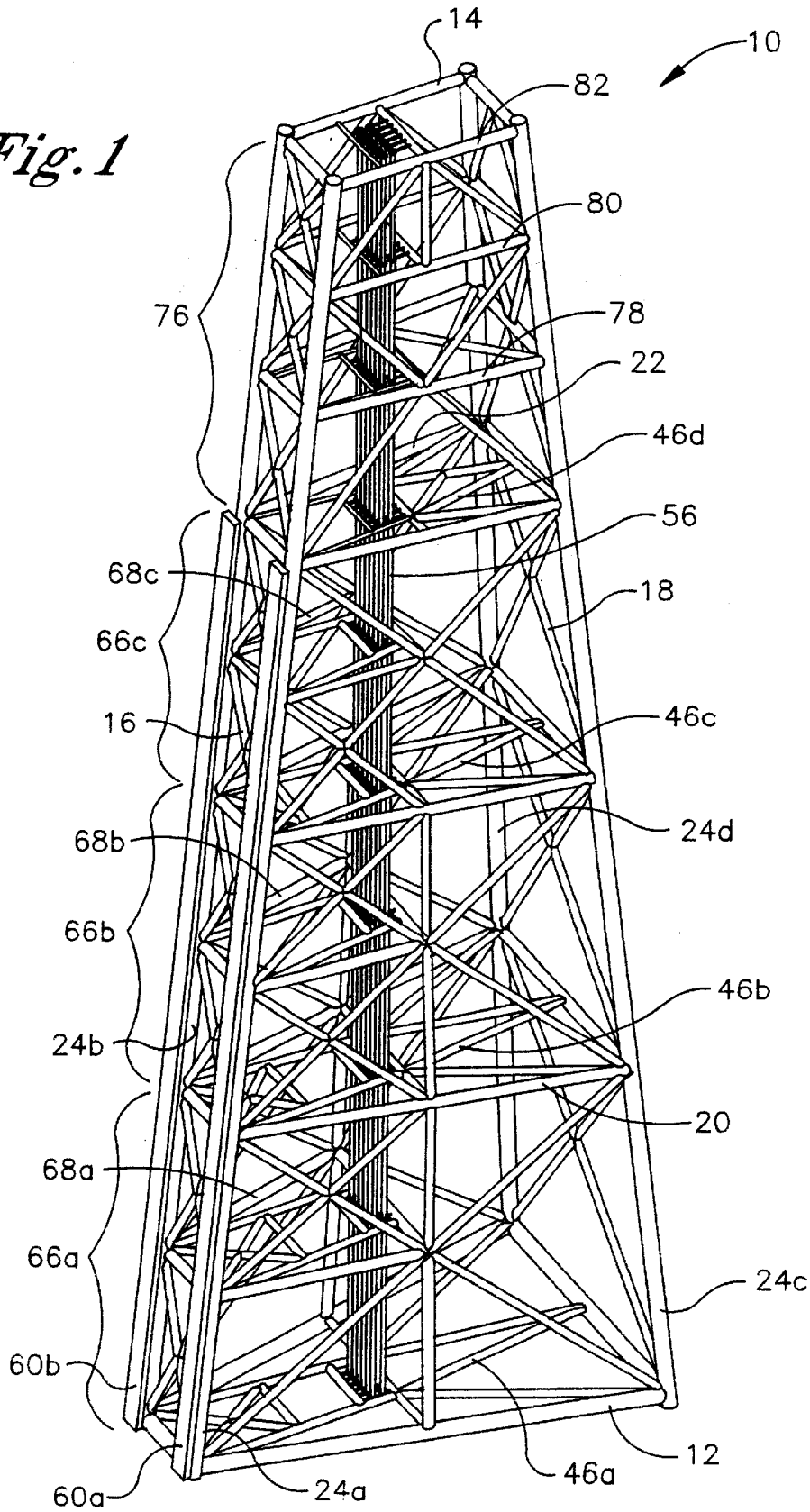
FIG. 1 is a conceptualized perspective view of a representative jacket of the present invention.

The present invention relates to the construction of a jacket having specific utility in a sea environment. The term "sea", as used herein, applies generally to substantially any large body of water, whether fresh water or salt water. Referring initially to FIG. 1, a representative jacket of the present invention, which is generally designated 10, is shown standing in an upright substantially vertical orientation. The jacket 10 is a framework having a base 12 and a top 14 and four elevational faces, i.e., a front face 16, a rear face 18, a first lateral face 20, and a second lateral face 22. Although the sea is not specifically shown in FIG. 1, it is understood that the jacket 10 is intended to stand in the sea with the base 12 positioned beneath the sea surface proximal to the sea floor. The base 12 is anchored to the sea floor in a conventional manner by a plurality of subsurface pilings (not shown), wherein one end of each piling is driven a substantial depth down into the sea floor and the opposite end of the piling protrudes up from the sea floor for attachment to the base 12. The jacket height is selected such that the top 14 of the jacket 10 is positioned a substantial height above the sea surface and provides a mount for an above-water deck (not shown), which is supported by the jacket 10. The above-water deck typically houses a hydrocarbon production facility. The jacket, in combination with the associated above-water deck and plurality of subsurface pilings, integrally forms an offshore platform.

The top 14 of the jacket 10 is preferably at a height of about 15 to 25 feet above the sea surface when the sea is calm. The present jacket 10 has general utility in sea depths between about 400 and 1500 feet. More preferably, the present jacket 10 has utility in sea depths between about 600 and 1200 feet. Accordingly, the height of the present jacket 10 is typically in a range from about 615 to 1225 feet. The remaining height of the offshore platform is provided by the pilings and the above-water deck.

The framework of the jacket 10 comprises a first outside leg 24*a*, a second outside leg 24*b*, a third outside leg 24*c* and a fourth outside leg 24*d*, which are the primary vertical support members of the jacket 10. The outside legs 24*a*, 24*b*, 24*c*, 24*d* extend substantially the entire height of the jacket 10 and have a hollow tubular construction. The outside legs 24*a*, 24*b*, 24*c*, 24*d* are formed from a high-strength material such as steel or the like. The outside legs 24*a*, 24*b*, 24*c*, 24*d* have a near vertical orientation, which angles gradually inwardly from the base 12 to the top 14 of the jacket 10. Thus, the jacket 10 has a tapered configuration from the base 12 to the top 14, with the base 12 having a substantially larger horizontal areal footprint than the top 14. The outside legs 24*a*, 24*b*, 24*c*, 24*d* vertically frame the front face 16, rear face 18, first lateral face 20, and second lateral face 22 of the jacket 10.

Figure 2:
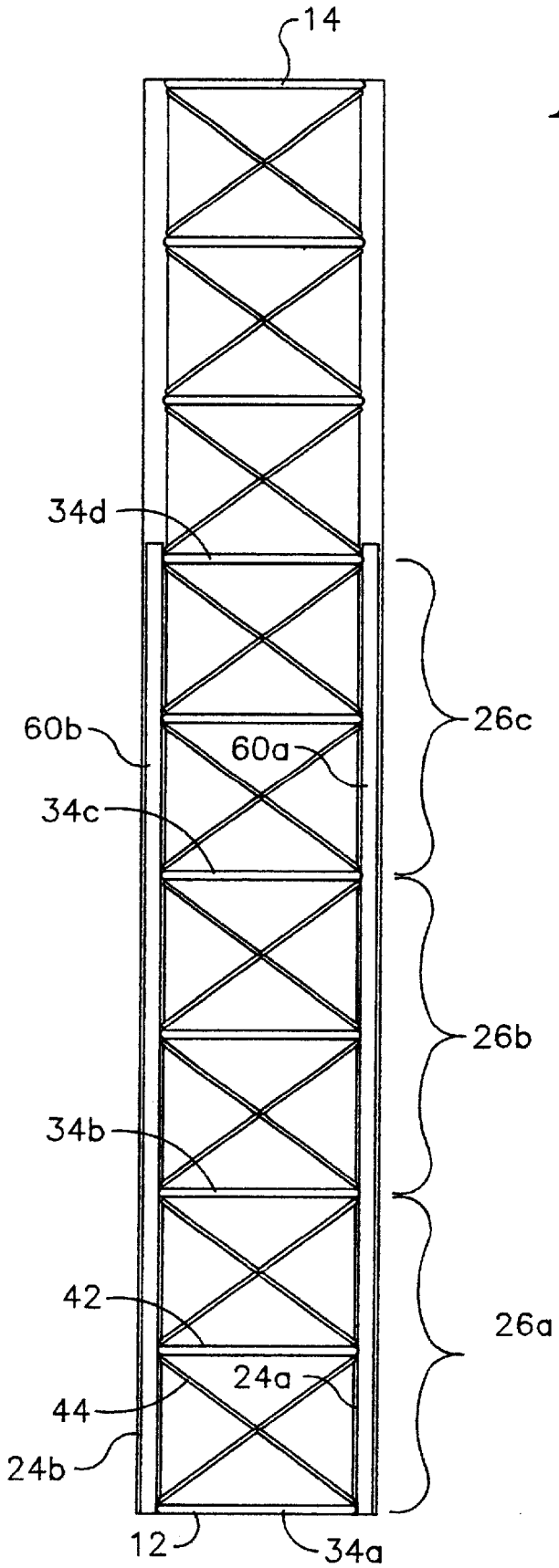
FIG. 2 is an elevational view of the front exterior frame sections of the jacket of FIG. 1.
Figure 3:
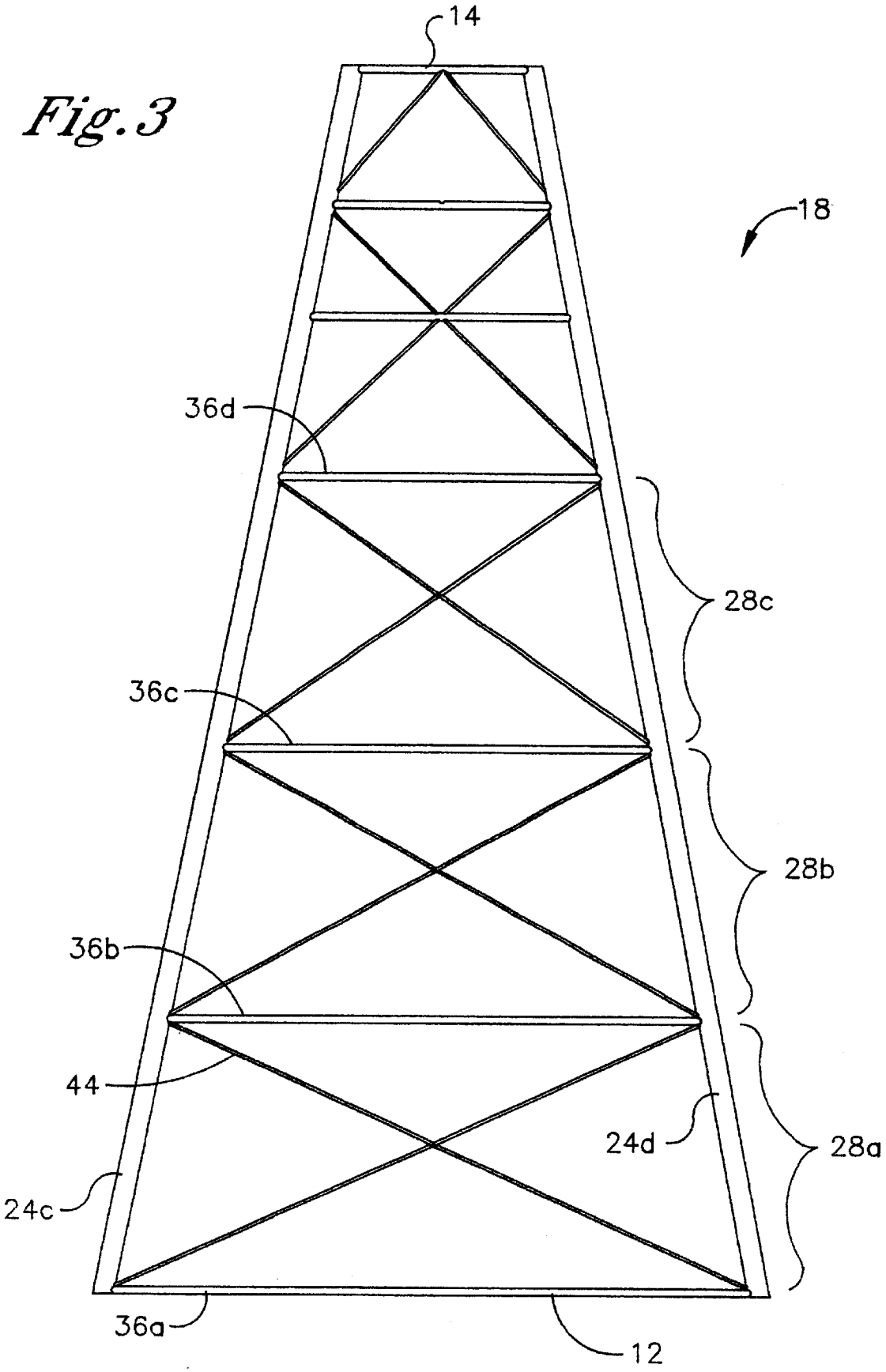
FIG. 3 is an elevational view of the rear exterior frame sections of the jacket of FIG. 1.
Figure 4:
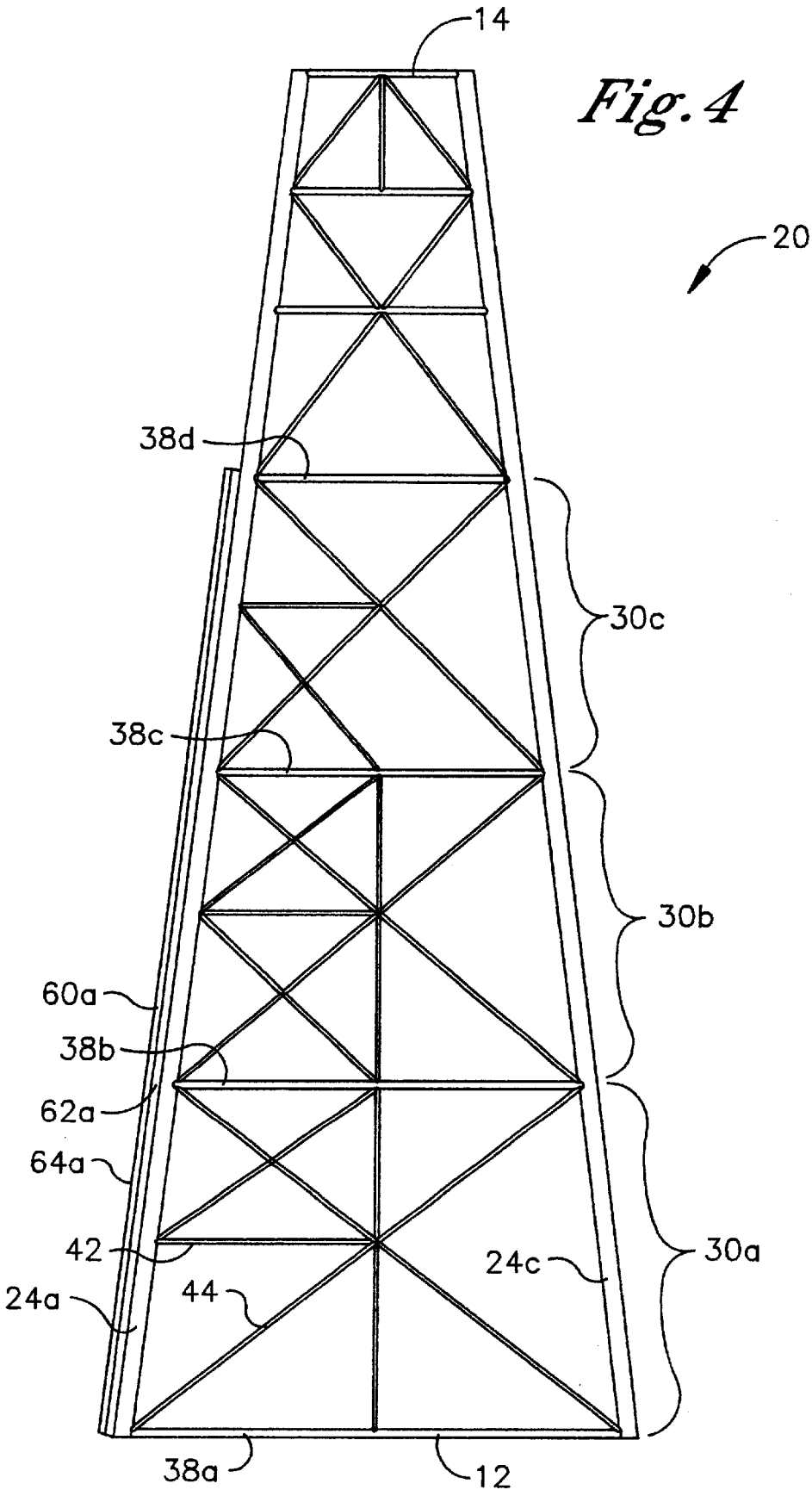
FIG. 4 is an elevational view of the first lateral exterior frame sections of the jacket of FIG. 1.
Figure 5:
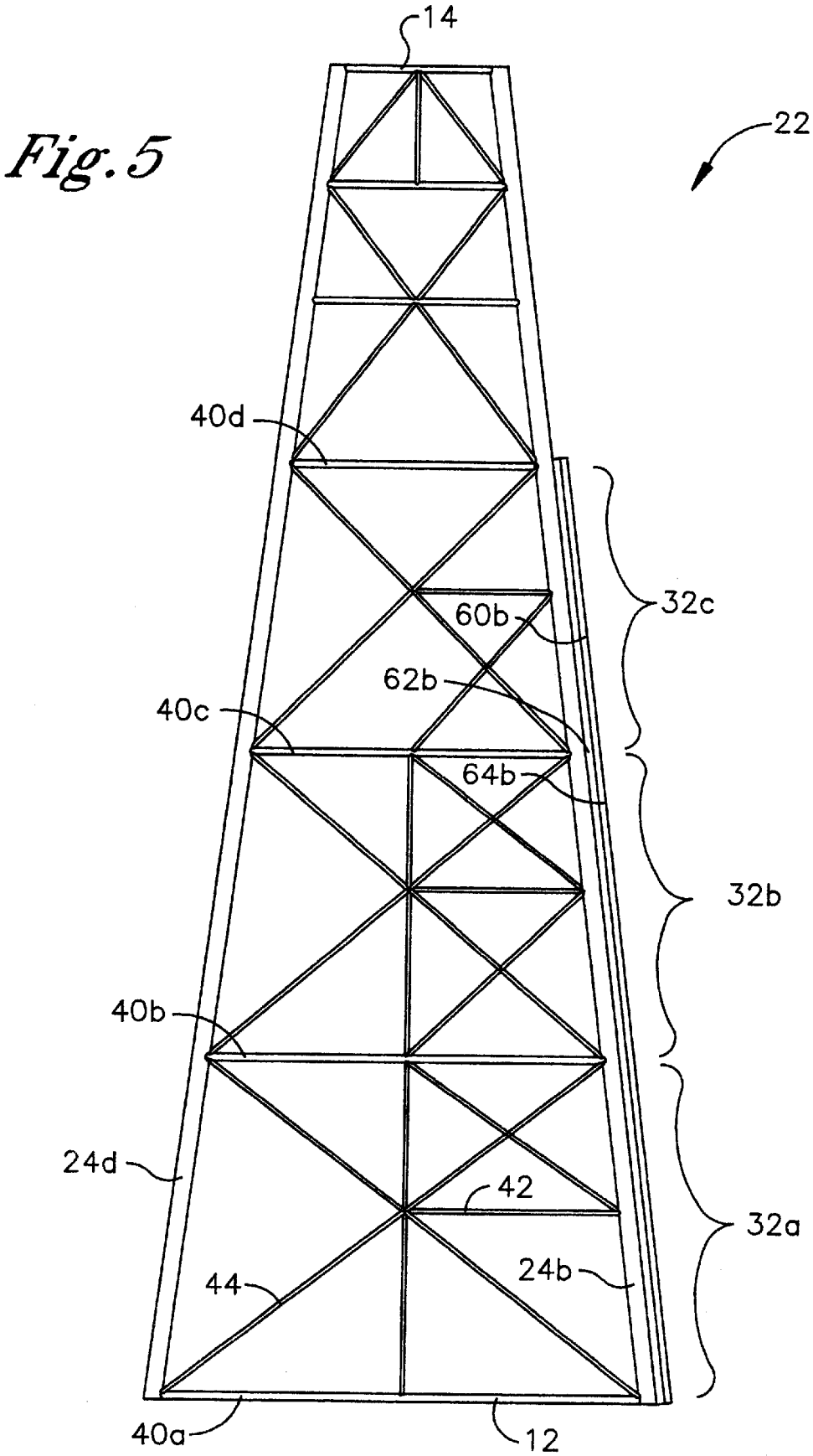
FIG. 5 is an elevational view of the second lateral exterior frame sections of the jacket of FIG. 1.

The front face 16, rear face 18, first lateral face 20, and second lateral face 22 of the jacket 10 are each comprised of a plurality of exterior frame sections. Representative configurations of the exterior frame sections for each face are shown in isolation with reference to FIGS. 2–5. In particular, FIG. 2 shows a representative configuration of the front exterior frame sections 26*a*, 26*b*, 26*c*, wherein the front exterior frame sections 26*a*, 26*b*, 26*c* are vertically aligned in series on the front face 16 of the jacket 10. It is noted that the first and second outside legs 24*a*, 24*b* are aligned in a substantially parallel orientation relative to one another along substantially their entire vertical length. FIG. 3 shows a representative configuration of the rear exterior frame sections 28*a*, 28*b*, 28*c*, wherein the rear exterior frame sections 28*a*, 28*b*, 28*c* are vertically aligned in series on the rear face 18 of the jacket 10. It is noted that the third and fourth outside legs 24*c*, 24*d* are aligned in a substantially convergent orientation relative to one another as the third and fourth outside legs 24*c*, 24*d* extend from base 12 to top 14 along their vertical length. FIG. 4 shows a representative configuration of the first lateral exterior frame sections 30*a*, 30*b*, 30*c*, wherein the first lateral exterior frame sections 30*a*, 30*b*, 30*c* are vertically aligned in series on the first lateral face 20. FIG. 5 shows a representative configuration of the second lateral exterior frame sections 32*a*, 32*b*, 32*c*, wherein the second lateral exterior frame sections 32*a*, 32*b*, 32*c* are vertically aligned in series on the second lateral face 22. Each of the exterior frame sections 26*a*–*c*, 28*a*–*c*, 30*a*–*c*, 32*a*–*c* is commonly characterized as having a planar quadrilateral configuration.

The framing of the vertical edges of the exterior frame sections 26*a*–*c*, 28*a*–*c*, 30*a*–*c*, 32*a*–*c* consists of segments of the outside legs 24*a*, 24*b*, 24*c*, 24*d*. The framing of the horizontal edges of the front exterior frame sections 26*a*, 26*b*, 26*c* consists of front members 34*a*, 34*b*, 34*c*, 34*d*. The framing of the horizontal edges of the rear exterior frame sections 28*a*, 28*b*, 28*c* consists of rear members 36*a*, 36*b*, 36*c*, 36*d*. The framing of the horizontal edges of the first lateral exterior frame sections 30*a*, 30*b*, 30*c* consists of first lateral members 38*a*, 38*b*, 38*c*, 38*d*. The framing of the horizontal edges of the second lateral exterior frame sections 32*a*, 32*b*, 32*c* consists of second lateral members 40*a*, 40*b*, 40*c*, 40*d*. The remaining framing of the exterior frame sections 26*a*–*c*, 28*a*–*c*, 30*a*–*c*, 32*a*–*c* includes a plurality of horizontal exterior cross members 42 and a plurality of diagonal exterior cross members 44. In the interest of clarity, at most only one horizontal exterior cross member and only one diagonal exterior cross member are designated by reference characters in each of FIGS. 2–5, the remaining undesignated horizontal and diagonal cross members being readily apparent. The horizontal and diagonal cross members 42, 44 are fabricated from lengths of hollow tubing, which are formed from a high-strength material such as steel or the like. The structural members of the jacket 10 are joined together in the representative configurations shown in FIGS. 2–5 by conventional means such as welding or the like.

Figure 6:
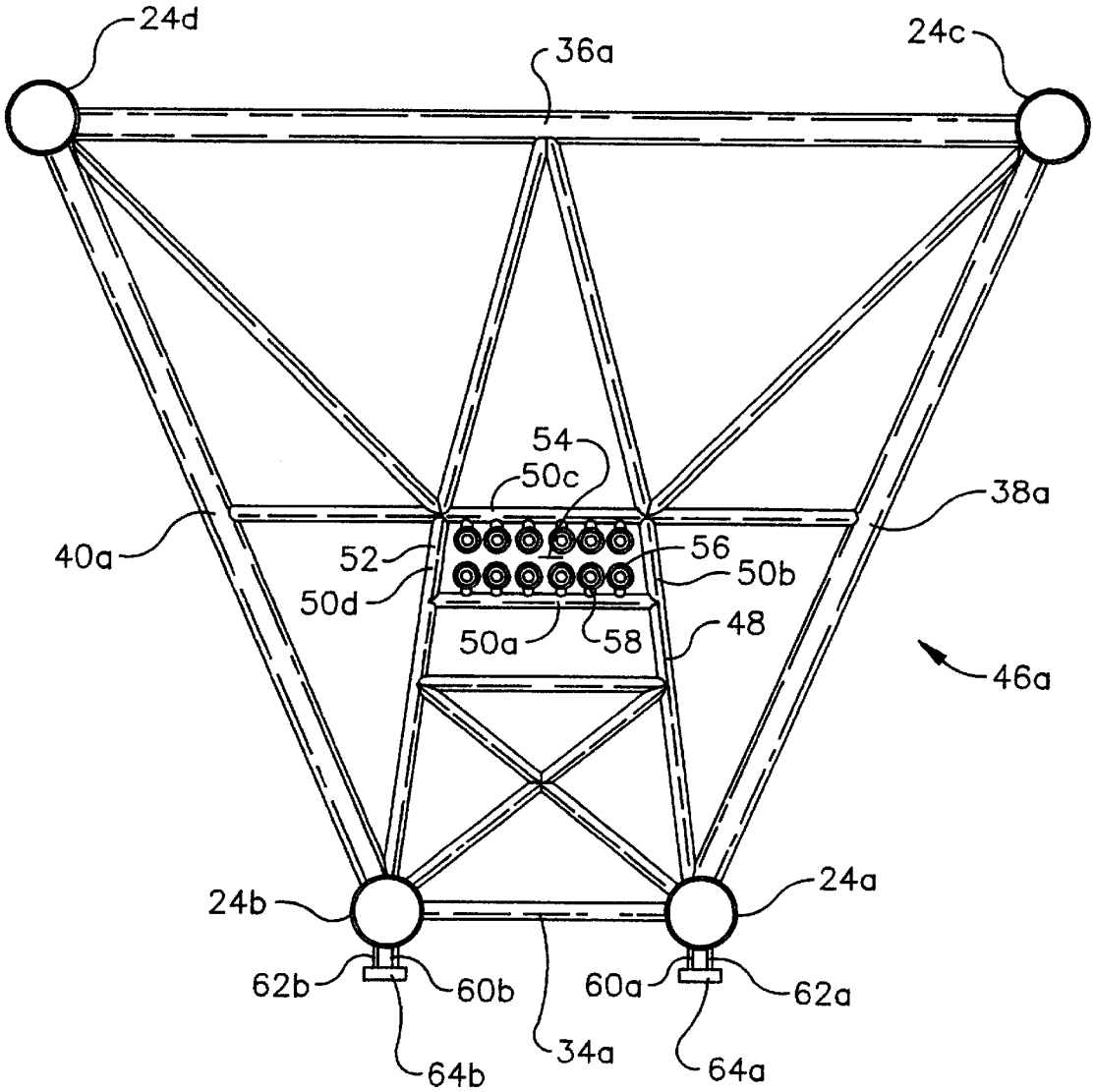
FIG. 6 is a top view of a cross-sectional frame section of the jacket of FIG. 1.

Referring back to FIG. 1 and additionally to FIG. 6, the outside legs 24*a*, 24*b*, 24*c*, 24*d* of the jacket 10 are interconnected at periodic intervals along the height of the jacket 10 from the base 12 toward the top 14 by cross-sectional frame sections 46*a*, 46*b*, 46*c*, 46*d*, each of which has a horizontal orientation. Although the dimensions of each cross-sectional frame section 46*a*, 46*b*, 46*c*, 46*d* diminish sequentially from the base 12 upward due to the tapered configuration of the jacket 10, the cross-sectional frame sections 46*a*, 46*b*, 46*c*, 46*d* all have substantially the same basic geometric configuration. Details of a representative configuration of the cross-sectional frame section 46*a* are shown in FIG. 6. The cross-sectional frame section 46*a* has a trapezoidal profile, wherein the outside legs 24*a*, 24*b*, 24*c*, 24*d* in cross section define the corners of the trapezoid. The first and second outside legs 24*a*, 24*b* are more closely spaced relative to the third and fourth outside legs 24*c*, 24*d* and, conversely, the third and fourth outside legs 24*c*, 24*d* are more widely spaced relative to the first and second outside legs 24*a*, 24*b*.

The exterior framing of the cross-sectional frame section 46*a* comprises the cross sections of the outside legs 24*a*, 24*b*, 24*c*, 24*d*, the front member 34*a*, the rear member 36*a*, the first lateral member 38*a* and the second lateral side member 40*a*. One end of the front member 34*a* and one end of the first lateral member 38*a* are connected to the first outside leg 24*a*. The remaining end of the front member 34*a* and one end of the second lateral member 40*a* are connected to the second outside leg 24*b*. Similarly one end of the rear member 36*a* and the remaining end of the first lateral member 38*a* are connected to the third outside leg 24*c*. The remaining end of the rear member 36*a* and the remaining end of the second lateral member 40*a* are connected to the fourth outside leg 24*d*. The front and rear members 34*a*, 36*a* are aligned in parallel with one another and are oriented such that a line drawn between the center points of the front and rear members 34*a*, 36*a* is perpendicular to the front and rear members 34*a*, 36*a*. The rear member 36*a* is substantially longer than the front member 34*a*, while the first and second lateral members 38*a*, 40*a* have substantially the same length. The first and second lateral members 38*a*, 40*a* are aligned in convergence with one another. As such, the cross-sectional frame section 46*a* is substantially symmetrical about its central vertical axis as shown in FIG. 6.

The exterior framing 24*a*, 24*b*, 24*c*, 24*d*, 34*a*, 36*a*, 38*a*, 40*a* of the cross-sectional frame section 46*a* is augmented by interior framing which is comprised of a plurality interior cross members generally designated 48. The interior cross members 48 are fabricated from lengths of hollow tubing, which are formed from a high-strength material such as steel or the like. Each of the interior cross members 48 is fixedly attached by conventional means such as welding or the like to another interior cross member 48 and/or to the exterior framing 24*a*, 24*b*, 24*c*, 24*d*, 34*a*, 36*a*, 38*a*, 40*a* of the cross-sectional frame section 46*a* in accordance with the representative configuration shown in FIG. 6. The exterior and interior framing 24*a*, 24*b*, 24*c*, 24*d*, 34*a*, 36*a*, 38*a*, 40*a*, 48 in combination provide a rigid coplanar network of interconnected structural members.

The interior cross members 48, and in particular segments 50*a*, 50*b*, 50*c*, 50*d*, enclose a cross-sectional conductor box 52, which defines a cross-sectional conductor opening 54 through the cross-sectional frame section 46*a*. The cross-sectional conductor box 52 is an enclosed frame sufficiently sized to permit the passage of a plurality of conductors 56 therethrough. The conductors 56 are tubing lengths aligned substantially perpendicular to the cross-sectional frame section 46*a* and extending substantially continuously the entire length of the jacket 10, which provide communication between the above-water deck and the sea floor, thereby enabling drilling or other oil exploration or production related functions through the open interior of the conductors 56.

The cross-sectional conductor box 52 has a trapezoidal configuration and is spatially separated from, but fixedly connected to, the exterior framing 34*a*, 36*a*, 38*a*, 40*a* of the cross-sectional frame section 46*a*. The cross-sectional frame section 46*a* laterally supports each of the conductors 56 passing through the cross-sectional conductor box 52. Lateral support for each conductor 56 is specifically provided by a cross-sectional conductor guide 58, which has a ring or tubing segment configuration. The outside of the cross-sectional conductor guide 58 is fixedly attached to the segment 50*a* or the segment 50*c* of the cross-sectional conductor box 52 and the interior opening of the cross-sectional conductor guide 58 is sized in close fitting relationship with the outside diameter of the conductor 56 to slidably receive the conductor 56 therethrough. Thus, the cross-sectional conductor guides 58 permit the conductors 56 to move vertically independent of the cross-sectional frame section 46*a*, which is particularly desirable if the conductors 56 exhibit different expansion properties than the remainder of the jacket 10. However, the cross-sectional conductor guides 58 substantially prevent the conductors 56 from moving laterally independent, i.e., horizontally independent, of the cross-sectional frame section 46*a*. As a result, slidable engagement of the cross-sectional frame section 46*a* with the conductors 56 by means of the cross-sectional conductor guides 58 and cross-sectional conductor box 52 not only provides lateral support for the conductors 56, but isolates the jacket 10 from vertical loads in the conductors 56.

Although the cross-sectional conductor box 52 is shown in the configuration of a trapezoid, the present invention is not limited to any particular configuration of the conductor box. However, in all cases, the conductors are dynamically interconnected with the exterior framing of the jacket, for example, by means of slidable engagement with the connector guides, which in turn are fixably connected to the cross-sectional conductor box as shown herein.

The entire exterior framing of the jacket 10, as shown and described above with reference to FIGS. 2–5, defines a jacket launch box, which is wholly integrated with the structure of the jacket 10. In particular, the front face 16 of the jacket 10 provides the bottom framing of the integral jacket launch box, while the first and second lateral faces 20, 22 provide the side framing and the rear face 18 provides the top framing of the integral jacket launch box. The rear face 18 incurs significantly lower launch loads than the remaining faces 16, 20, 22 because none of its members are required to pivot against the transport barge when launching the jacket 10. As such, there is a substantially higher density of horizontal and diagonal cross members 42, 44 in the faces 16, 20, 22 than in the face 18 to distribute the launch loads throughout the jacket structure. The front face 16 and first and second lateral faces 20, 22 also include supplemental horizontal and diagonal cross members 42, 44 near the base 12 of the jacket 10 to provide additional strength for the larger launch loads and in-place operating loads encountered near the base 12.

Referring additionally to FIG. 6, the specific portion of the exterior framing of the jacket 10, which is included in the cross-sectional frame section 46*a*, defines a frame section portion of the integral jacket launch box. The frame section portion is fortified by the interior cross members 48, which are enclosed within the exterior framing 24*a*, 24*b*, 24*c*, 24*d*, 34*a*, 36*a*, 38*a*, 40*a*. The integral jacket launch box provides sufficient support for the jacket 10 when it is being launched front face 16 down at a desired offshore site (not shown) to prevent undue bending or collapse of the jacket 10. Once the jacket 10 is in place at the desired offshore site, the integral jacket launch box provides the jacket 10 with sufficient strength and rigidity to support the above-water deck while resisting wave forces.

The integral jacket launch box is further provided with first and second launch runners 60*a*, 60*b*, which are shown in FIGS. 1, 2 and 4–6. The first and second launch runners 60*a*, 60*b* facilitate loading of the jacket 10 onto a transport barge (not shown) and launching of the jacket 10 from the transport barge. The first and second launch runners 60*a*, 60*b* have first and second connectors 62*a*, 62*b*, respectively, which mount the first and second launch runners 60*a*, 60*b* on the exterior of the first and second outside legs 24*a*, 24*b*, respectively. The first and second launch runners 60*a*, 60*b* also have first and second narrow flat-bottomed skids 64*a*, 64*b*, respectively, usually formed from timber, which are connected to the first and second connectors 62*a*, 62*b*. The first and second skids 64*a*, 64*b* are in continuous contact with correspondingly dimensioned narrow skidways (not shown) formed on the deck of the transport barge while the jacket 10 is being transported to the desired offshore site. As the jacket 10 is being launched, the first and second skids 64*a*, 64*b* slide along the parallely aligned skidways until the jacket 10 slides off the transport barge.

Although the first and second outside legs 24*a*, 24*b* are shown in FIG. 2 as being aligned in parallel relative to each other over their entire length, it is only necessary for the first and second outside legs 24*a*, 24*b* to be parallel to each other over the portion of their length having the first and second launch runners 60*a*, 60*b* mounted thereon. In some cases it may be desirable for the first and second outside legs 24*a*, 24*b* to angle or curve inward toward each other as the top 14 of the jacket 10 is approached to facilitate transitioning of the jacket cross section from a trapezoidal profile to a rectangular profile in a manner described below.

Figure 7:
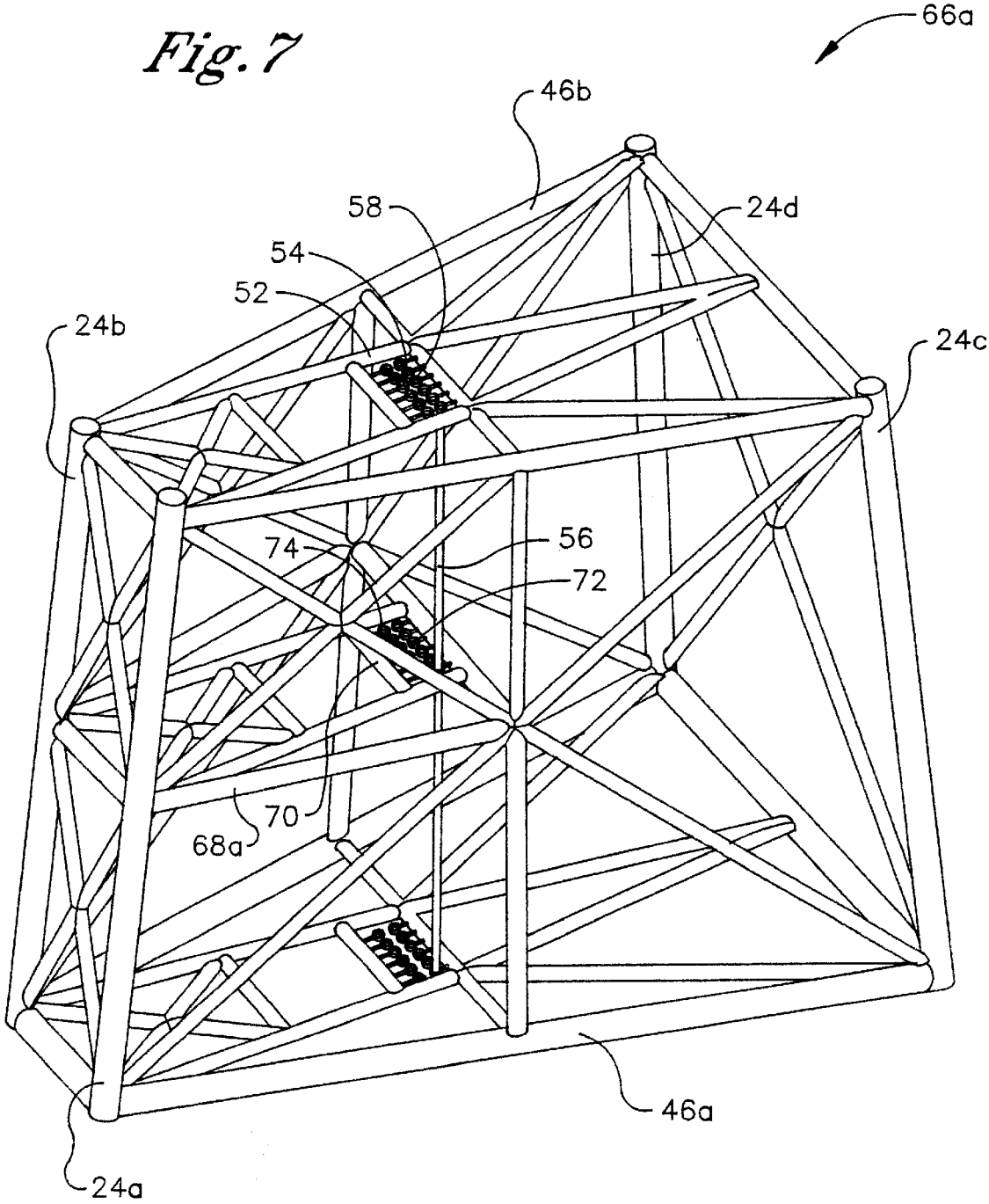
FIG. 7 is a perspective view of a repeating bay of the jacket of FIG. 1.

Referring back to FIG. 1 and additionally to FIG. 7, the construction of the jacket 10 is characterized by a plurality of repeating bays 66*a*, 66*b*, 66*c*, which are vertically stacked atop one another from the base 12 upward, interfacing each other at the cross-sectional frame sections 46*a*, 46*b*, 46*c*, 46*d*. The cross-sectional dimensions of each repeating bay 66*a*, 66*b*, 66*c* diminish sequentially from the base 12 upward due to the tapered configuration of the jacket 10, but the repeating bays 66*a*, 66*b*, 66*c* all have substantially the same basic geometric configuration. Although the present invention is not so limited, a typical height of each repeating bay 66*a*, 66*b*, 66*c* is on the order of about 180 feet. Details of a representative configuration of the repeating bay 66*a* are shown with reference to FIG. 7.

The repeating bay 66*a* is bounded at its bottom by the cross-sectional frame section 46*a* and at its top by the cross-sectional frame section 46*b*. The front, rear, first lateral and second lateral faces of the repeating bay 66*a* are as described above with reference to FIGS. 2–5. The repeating bay 66*a* is further provided with an intermediate frame section 68*a* preferably positioned about halfway between the cross-sectional frame sections 46*a*, 46*b*. (The remaining intermediate frame sections 68*b*, 68*c* of the jacket 10 are shown in FIG. 1, which have substantially the same basic geometric configuration as the intermediate frame section 68*a*.) Like the cross-sectional frame sections 46*a*, 46*b*, the intermediate frame section 68*a* has a horizontal orientation and a trapezoidal profile. However, the intermediate frame section 68*a* does not extend across the entire cross section of the jacket 10. Only the cross sections of the first and second outside legs 24*a*, 24*b* are included within the exterior framing of the intermediate frame section 68*a*. Nevertheless, the exterior and interior framing of the intermediate frame section 68*a*, in accordance with the configuration shown in FIG. 7, likewise provide a rigid coplanar network of interconnected members.

The intermediate frame section 68*a* has an intermediate conductor box 70 defining an intermediate conductor opening 72. The intermediate conductor box 70 and intermediate conductor opening 72 are vertically aligned with the corresponding cross-sectional conductor box 52 and cross-sectional conductor opening 54 of the cross-sectional frame sections 46*a*, 46*b*. The intermediate conductor box 70 is provided with intermediate conductor guides 74 in substantially the same manner as the cross-sectional conductor box 52. As such, the intermediate conductor box 70 and intermediate conductor opening 72 augment the function of the corresponding cross-sectional conductor box 52 and cross-sectional conductor opening 54 of the cross-sectional frame sections 46*a*, 46*b*, providing additional lateral support for the conductors 56. Thus, where the height of each repeating bay 66*a*, 66*b*, 66*c* is about 180 feet, the conductors 56 are laterally supported about every 90 feet along the entire height of the jacket 10. In the interest of clarity, only the footprints of the conductors 56 are shown within the conductor boxes 52, 70 in FIG. 7. However, it is understood that the conductors 56 extend continuously in a vertical orientation through the entire repeating bay 66*a*.

In addition to the repeating bays 66*a*, 66*b*, 66*c*, the jacket 10 further comprises an upper bay 76, which occupies the uppermost position at the top 14 of the jacket 10 where the above-water deck is mounted on the jacket 10. The configuration of the upper bay 76 diverges from the repeating bays 66*a*, 66*b*, 66*c* because of the mounting function of the upper bay 76. Like the repeating bays 66*a*, 66*b*, 66*c*, the upper bay 76 includes a bottom cross section 46*d* having a trapezoidal profile. The upper bay 76 also includes intermediate cross sections 78, 80 and a top cross section 82, which has a rectangular profile to accommodate mounting the above-water deck. The first and second lateral faces 20, 22 become warped approaching the top 14 of the jacket 10, thereby losing their planarity to effect transition of the top cross section 82 to a rectangular profile. The trapezoidal profiles of the intermediate cross sections 78, 80 also narrow with respect to the rear face 18 to effect transition of the top cross section 82 to a rectangular profile. This warpage and narrowing may extend below the upper bay 76 into the repeating bays 66*a*, 66*b*, or 66*c*, if desired. The entire height of the present jacket 10 is the equivalent of about 4.5 repeating bays, which has specific utility for placement of the jacket 10 at a sea depth of about 750 feet.

In any case, it is understood that the jacket 10 shown in FIGS. 1–7 is merely a conceptualized representation of the jacket of the present invention. In practice, the jacket may require more or fewer of the vertically stacked repeating bays than shown to obtain the desired height of a jacket having utility in offshore environments. As noted above, all of the repeating bays have substantially the same basic geometric configuration. However, as the repeating bays become more distant from the base of the jacket, it may be possible to omit the intermediate frame sections from the repeating bays approaching the upper bay without unduly diminishing the lateral support provided to the conductors.

Although the jacket configuration described above and shown in FIGS. 1–7 is a representative preferred embodiment of the present invention, the present invention is not limited to any one specific jacket configuration. Other jacket configurations are possible within the scope of the present invention, particularly with respect to the number and arrangement of the horizontal cross members 42, diagonal cross members 44, and interior cross members 48. The jacket configuration may also be uniformly straight rather than tapered as it extends in height from its base to its top. In accordance with such an embodiment, the four outside legs all have a uniform vertical orientation, rather than near vertical orientation.

In all cases the jacket configurations of the present invention have a number of common characteristics. Specifically, the jacket is designed to be fixed to the sea floor by means of pilings or the like. The jacket is a framework having a continuous trapezoidal cross section along the majority of its height, if not substantially all of its height. The exterior framing of the jacket has four outside legs, which are the primary vertical support members of the jacket and define the corners of the trapezoidal cross section. Two of the outside legs are more closely spaced and are aligned in parallel relative to each other over their entire length or at least the portion of their length having launch runners mounted thereon. The two remaining outside legs are more widely spaced. Cross-sectional frame sections are provided at periodic intervals along the height of the jacket from the base toward the top, which interconnect the outside legs. The cross-sectional frame sections are horizontally oriented and have a trapezoidal profile corresponding to the trapezoidal cross section of the jacket. Each cross-sectional frame section encloses a conductor box and makes up a portion of an integral jacket launch box. The conductors vertically extending through the horizontal conductor box are laterally supported by the cross-sectional frame section. The combination of these characteristics inter alia renders the jacket substantially rigid relative to prior art compliant jackets. A rigid jacket is defined herein as a jacket having a sway period significantly shorter than the peak spectral energy of the surrounding wave environment, whereas a compliant jacket has a sway period significantly longer than the peak spectral energy of the surrounding wave environment The specific structure of the jacket of the present invention, wherein the jacket has four outside legs as primary vertical support members (two more closely spaced and two more widely spaced) and displays a continuous trapezoidal cross section, is termed a "quadrapod" structure.

The quadrapod jacket simulates a tripod, but replaces one of the legs of the tripod with the two more closely spaced legs fitted with launch runners, while the two remaining legs of the tripod are the two more widely spaced legs. The quadrapod structure enables the practitioner to integrate the jacket launch box with the exterior framing of the jacket, thereby increasing the overall strength and rigidity of the jacket while reducing the overall complexity, weight and cost of the jacket. Periodic slidable engagement of the conductors with the jacket by means of conductor boxes and conductor guides periodically spaced along the height of the jacket supports the conductors while isolating the jacket from vertical loads in the conductors.

While the forgoing preferred embodiments of the invention have been described and shown, it is understood that alternatives and modifications, such as those suggested and others, may be made thereto and fall within the scope of the invention.

I claim:

1. An offshore jacket for installation in a sea environment having a sea surface and a sea floor, said jacket having a base, a top and a height extending from said base to said top, and said jacket comprising:

exterior framing including four outside legs each extending at least a majority of said height of said jacket upwardly from beneath the sea surface to at least the sea surface, wherein a first pair of said four outside legs is more closely spaced apart and a second pair of said four outside legs is more widely spaced apart to define four corners of a trapezoidal cross section of said exterior framing;

a plurality of cross-sectional frame sections horizontally positioned at periodic intervals along said height of said jacket between said base and said top, wherein each said cross-sectional frame section interconnects said four outside legs and encloses a cross-sectional conductor opening having at least one substantially perpendicularly oriented conductor passing therethrough from said base to said top; and a cross-sectional conductor guide positioned in each said conductor opening and connected to said cross-sectional frame section, wherein said cross-sectional conductor guide slidably engages said at least one conductor to laterally support said at least one conductor, thereby permitting independent vertical movement of said at least one conductor relative to said cross-sectional frame section while substantially preventing independent horizontal movement of said at least one conductor relative to said cross-sectional frame section, and further thereby enabling said at least one conductor to supplement lateral support of said jacket while isolating said jacket from vertical loads in said at least one conductor;

wherein said jacket is rigid, said rigid jacket characterized as having a sway period shorter than a wave period of peak spectral energy of a surrounding wave environment in comparison to a compliant jacket characterized as having a sway period longer than a wave period of peak spectral energy of a surrounding wave environment.

2. The offshore jacket of claim 1, wherein each of said cross-sectional frame sections has a front member, a rear member, a first lateral member and a second lateral member, and wherein said front, rear, first lateral, and second lateral members interconnect said four outside legs.

3. The offshore jacket of claim 2, wherein said exterior framing of said jacket includes said front, rear, first lateral, and second lateral members, and further wherein said front, rear, first lateral, and second lateral members in association with said four outside legs provide each of said cross-sectional frame sections with a cross section corresponding to said trapezoidal cross section of said exterior framing.

4. The offshore jacket of claim 3, wherein said exterior framing of said jacket defines an integral launch box.

5. The offshore jacket of claim 4, further comprising a first launch runner mounted on one of said first pair of outside legs more closely spaced apart and a second launch runner mounted on the other of said first pair of outside legs.

6. The offshore jacket of claim 5, wherein said first pair of outside legs has a substantially parallel orientation where said first and second launch runners are mounted on said first pair of outside legs.

7. The offshore jacket of claim 1, further comprising an intermediate frame section horizontally positioned between said cross-sectional frame sections and only partially extending across said trapezoidal cross section of said exterior framing, wherein said intermediate frame section encloses an intermediate conductor opening having said at least one conductor passing therethrough.

8. The offshore jacket of claim 7, further comprising an intermediate conductor guide positioned in each said intermediate conductor opening and connected to said intermediate frame section, wherein said intermediate conductor guide slidably engages said at least one conductor to laterally support said at least one conductor, thereby permitting independent vertical movement of said at least one conductor relative to said intermediate frame section while substantially preventing independent horizontal movement of said at least one conductor relative to said intermediate frame section.

9. An offshore jacket for installation in a sea environment having a sea surface and a sea floor, said jacket having a base, a top and a height extending from said base to said top, and said jacket comprising:

exterior framing including four outside legs each extending at least a majority of said height of said jacket upwardly from beneath the sea surface to at least the sea surface, wherein a first pair of said four outside legs is more closely spaced apart and a second pair of said four outside legs is more widely spaced apart to define four corners of a trapezoidal cross section of said exterior framing;

a plurality of cross-sectional frame sections horizontally positioned at periodic intervals along said height of said jacket between said base and said top, wherein each said cross-sectional frame section encloses a cross-sectional conductor opening having at least one substantially perpendicularly oriented conductor passing therethrough from said base to said top and has a front member, a rear member, a first lateral member and a second lateral member interconnecting said four outside legs and included in said exterior framing of said jacket, and wherein said exterior framing defines an integral launch box having sufficient structural integrity to withstand a skid launch of said jacket from a launch barge; and a cross-sectional conductor guide positioned in each said conductor opening and connected to said cross-sectional frame section, wherein said cross-sectional conductor guide slidably engages said at least one conductor to laterally support said at least one conductor, thereby permitting independent vertical movement of said at least one conductor relative to said cross-sectional frame section while substantially preventing independent horizontal movement of said at least one conductor relative to said cross-sectional frame section, and further thereby enabling said at least one conductor to supplement lateral support of said jacket while isolating said jacket from vertical loads in said at least one conductor;

wherein said jacket is rigid, said rigid jacket characterized as having a sway period shorter than a wave period of peak spectral energy of a surrounding wave environment in comparison to a compliant jacket characterized as having a sway period longer than a wave period of peak spectral energy of a surrounding wave environment.

10. The offshore jacket of claim 9, further comprising a first launch runner mounted on one of said first pair of outside legs more closely spaced apart and a second launch runner mounted on the other of said first pair of outside legs.

11. The offshore jacket of claim 10, wherein said first pair of outside legs has a substantially parallel orientation where said first and second launch runners are mounted on said first pair of outside legs.

12. A method for placing an offshore jacket at an offshore site in a sea environment having a sea floor and a sea surface, said method comprising:

providing said jacket having a height extending from a base to a top, wherein said jacket comprises exterior framing including four outside legs each extending at least a majority of said height of said jacket, wherein a first pair of said four outside legs is more closely spaced apart and a second pair of said four outside legs is more widely spaced apart to define four corners of a trapezoidal cross section of said exterior framing and a plurality of cross-sectional frame sections horizontally positioned at periodic intervals along said height of said jacket between said base and said top, wherein each said cross-sectional frame section has a front member, a rear member, a first lateral member and a second lateral member interconnecting said four outside legs and included in said exterior framing of said jacket, and wherein said exterior framing defines an integral launch box;

extending at least one conductor from said base to said top, wherein said at least one conductor passes through each said cross-sectional frame section;

slidably engaging said at least one conductor with each said cross-sectional frame section to laterally support said at least one conductor, thereby permitting independent vertical movement of said at least one conductor relative to said cross-sectional frame section while substantially preventing independent horizontal movement of said at least one conductor relative to said cross-sectional frame section when said jacket is in a vertical orientation, and further thereby enabling said at least one conductor to supplement lateral support of said jacket while isolating said jacket from vertical loads in said at least one conductor;

mounting a first launch runner on one of said first pair of outside legs more closely spaced apart and mounting a second launch runner on the other of said first pair of outside legs;

positioning said jacket on a barge deck of a transport barge in a horizontal orientation with said first and second launch runners engaging said barge deck;

transporting said jacket on said transport barge to said offshore site;

launching said jacket from said transport barge at said offshore site by sliding said first and second launch runners along said barge deck, wherein said integral launch box bears launch loads on said jacket to prevent structural failure of said jacket; and fixing said jacket to said sea floor, wherein said base is proximal to said sea floor and said top is proximal to said sea surface with said outside legs extending upwardly from beneath the sea surface to at least the sea surface and wherein said jacket is rigid, said rigid jacket characterized as having a sway period shorter than a wave period of peak spectral energy of a surrounding wave environment at said offshore site in comparison to a compliant jacket characterized as having a sway period longer than a wave period of peak spectral energy of a surrounding wave environment.

13. The method of claim 12 further comprising mounting an above-water deck to said top, wherein said jacket rigidly supports said above-water deck.

14. The method of claim 12, wherein said first launch runner engages a first skidway formed in said barge deck and said second launch runner engages a second skidway formed in said barge deck.

15. The method of claim 14, wherein said first and second launch runners are in continuous contact with said first and second skidways until said jacket departs said barge deck.

16. The method of claim 12, wherein said first pair of outside legs has a substantially parallel orientation where said first and second launch runners are mounted on said first pair of outside legs.

* * * * *